US011547897B2

(12) United States Patent
Young

(10) Patent No.: US 11,547,897 B2
(45) Date of Patent: Jan. 10, 2023

(54) EXERCISE MAT INCLUDING PAINT AND PAPER CHAMBER

(71) Applicant: Alecia Dawn Young, Pittsburgh, PA (US)

(72) Inventor: Alecia Dawn Young, Pittsburgh, PA (US)

( * ) Notice: Subject to any disclaimer, the term of this patent is extended or adjusted under 35 U.S.C. 154(b) by 301 days.

(21) Appl. No.: 16/766,790

(22) PCT Filed: Nov. 28, 2018

(86) PCT No.: PCT/US2018/062840
§ 371 (c)(1),
(2) Date: May 26, 2020

(87) PCT Pub. No.: WO2019/108647
PCT Pub. Date: Jun. 6, 2019

(65) Prior Publication Data

US 2020/0316428 A1 Oct. 8, 2020

Related U.S. Application Data

(60) Provisional application No. 62/592,060, filed on Nov. 29, 2017.

(51) Int. Cl.

| | |
|---|---|
| ***A63B 21/00*** | (2006.01) |
| ***B44D 2/00*** | (2006.01) |
| ***B44D 3/18*** | (2006.01) |
| *A63B 71/06* | (2006.01) |

(52) U.S. Cl.
CPC ..... *A63B 21/4037* (2015.10); *B44D 2/00* (2013.01); *B44D 3/18* (2013.01); *A63B 2071/0647* (2013.01); *A63B 2071/0694* (2013.01); *A63B 2209/00* (2013.01); *A63B 2209/08* (2013.01); *A63B 2209/10* (2013.01)

(58) Field of Classification Search
CPC ..... A63B 21/4037; A63B 6/00
See application file for complete search history.

(56) References Cited

U.S. PATENT DOCUMENTS

| | | | | |
|---|---|---|---|---|
| 5,148,618 | A * | 9/1992 | Brewster | G09F 3/18 40/781 |
| 5,154,678 | A * | 10/1992 | Adamczyk | A63B 23/0458 482/52 |
| 6,594,872 | B2 | 7/2003 | Cisek | |
| 6,751,816 | B1 * | 6/2004 | Wechsler | A47G 9/062 383/4 |
| 9,738,059 | B2 | 8/2017 | Hing | |
| 2004/0250346 | A1 * | 12/2004 | Vasishth | A47G 27/0237 5/420 |

(Continued)

OTHER PUBLICATIONS

Days of May. "No Mess Finger Painting!!/Family Friendly Easy DIY Painting!!", YouTube, Aug. 6, 2017, Retrieved from the Internet: <https://www.youtube.com/watch?v=1aqebHgBeVs>.

*Primary Examiner* — Nyca T Nguyen
(74) *Attorney, Agent, or Firm* — The Webb Law Firm

(57) ABSTRACT

The present disclosure is directed to an exercise mat including a base layer, the base layer defining a recess therein configured to receive a cartridge holding paint and a painting surface, a top layer operatively connected to the base layer, at least one magnet or other fastening mechanism embedded within the base layer, and at least one magnet embedded within the top layer.

15 Claims, 6 Drawing Sheets

(56) References Cited

U.S. PATENT DOCUMENTS

2007/0225124 A1* 9/2007 Cabados ..... A63B 26/00 482/23
2008/0125290 A1* 5/2008 Cabados ..... A63B 6/00 482/23
2008/0214361 A1* 9/2008 Oster ..... A63B 21/4037 482/23
2009/0276957 A1* 11/2009 Boitet-Ball ..... B62B 1/266 224/264
2011/0035878 A1 2/2011 Rouse
2011/0052877 A1* 3/2011 Yeh ..... B32B 3/10 428/319.7
2011/0059830 A1* 3/2011 Reese ..... A63B 21/4037 482/142
2012/0317719 A1 12/2012 Ng
2013/0276230 A1 10/2013 Kress
2014/0068858 A1* 3/2014 Wambeke ..... A47G 9/062 5/420
2014/0259399 A1* 9/2014 Tsai ..... A63B 21/4037 5/420
2014/0287894 A1* 9/2014 Austin ..... A63B 21/4029 482/142
2015/0113731 A1* 4/2015 Liu ..... A63B 6/00 5/417
2016/0016028 A1 1/2016 Thompson et al.
2016/0047129 A1* 2/2016 Bowers ..... E04F 15/22 52/741.1
2016/0144214 A1* 5/2016 Leslie ..... A63B 6/00 482/26
2016/0287928 A1* 10/2016 Darnell ..... A63B 21/4037
2016/0332023 A1* 11/2016 Taylor ..... A47K 10/02
2017/0080278 A1* 3/2017 Wiggins ..... A47K 10/02
2017/0209742 A1* 7/2017 Merkel ..... A63B 71/0622
2017/0266485 A1* 9/2017 Willis ..... A63B 71/0036
2017/0291060 A1* 10/2017 Lin ..... B32B 5/06
2018/0043205 A1* 2/2018 Duffy ..... A63B 21/4037
2018/0272180 A1* 9/2018 Abrahams ..... A63B 21/4037
2018/0280751 A1* 10/2018 Prybutok ..... B32B 3/04
2018/0296014 A1* 10/2018 Carter ..... A47G 27/04
2018/0304114 A1* 10/2018 Feinstein ..... A63B 21/4037
2018/0353801 A1* 12/2018 Ruse ..... A47K 10/02
2020/0164611 A1* 5/2020 Natorski ..... B32B 7/06
2021/0244991 A1* 8/2021 Pickett ..... H01F 7/0252
2021/0275857 A1* 9/2021 Christ ..... A63B 21/4037
2021/0291009 A1* 9/2021 Paganini ..... A63B 24/0003
2021/0353997 A1* 11/2021 Gupta ..... A63B 21/4037
2021/0354893 A1* 11/2021 Loeffler ..... A45C 11/00
2022/0008279 A1* 1/2022 Conrad ..... A61G 15/002
2022/0118307 A1* 4/2022 Chapman ..... A63B 23/03508

* cited by examiner

EXERCISE MAT INCLUDING PAINT AND PAPER CHAMBER

CROSS-REFERENCE TO RELATED APPLICATIONS

This application is the United States national phase of PCT/US2018/062840 filed Nov. 28, 2018, and claims the benefit of U.S. Provisional Patent Application No. 62/592,060, filed on Nov. 29, 2017, the disclosures of which are hereby incorporated by reference in their entirety.

BACKGROUND OF THE INVENTION

Field of the Invention

The present disclosure is generally directed to exercise mats and, in particular, to yoga mats with a chamber for paint and a painting surface.

Description of Related Art

Yoga is an exercise method that helps practitioners to relax and stretch their bodies through breathing and the use of a variety of yoga poses. These specific yoga poses help to alleviate any tightness, pain, or stiffness in the practitioner's body due to bad posture habits, such as slouching, slumping, or crookedness, whether the practitioner is moving or resting in position. Yoga positions are designed to bring the practitioner's various body parts back into alignment so the bad posture habits can be corrected and, eventually, stopped.

To perform and move between these particular yoga poses, the practitioner will use an exercise mat, in particular a yoga mat, which is placed on the floor. Typically, the yoga mats are made out of a vinyl material, such as PVC, and provide a cushion to the practitioner as the practitioner moves his/her arms and legs into different positions on the yoga mat. Due to the many different yoga poses available to a practitioner, the practitioner will move his/her body parts into many different positions and pressure points on the yoga mat. Currently, however, there is no efficient method for recording or identifying the different positions the practitioner's body moves between using different yoga positions. While several current yoga or exercise mats use thermochromic ink to identify pressure points on the yoga mat from the practitioner's body parts, current yoga or exercise mats do not include an arrangement for recording these positions of the practitioner's body parts on a medium that allows the practitioner to display these imprints separate from the yoga or exercise mat.

SUMMARY OF THE INVENTION

In view of the description above, there is a current need for a yoga mat that includes an arrangement to allow a practitioner to record or identify the many different positions the practitioner's body moves between using different yoga positions. Further, there is a current need for a yoga mat that includes a paint and painting surface arrangement that permits the practitioner to create a painting by moving between different yoga positions on the yoga mat.

In one example of the present disclosure, an exercise mat includes a base layer having a bottom surface, a top surface, and at least one fastener, a top layer having a bottom surface, a top surface, and at least one fastener that is configured to connect with the at least one fastener of the base layer. In this example, the top surface of the base layer and the bottom surface of the top layer are configured to be facing one another. In another example of the present disclosure, the fasteners in the base layer and top layer may be magnets. The top layer may also be configured to roll away from the base layer. In another example, the exercise mat may have the bottom surface of the top layer and the top surface of the bottom layer configured to receive an insert between the surfaces. The insert may comprise a painting surface and paint. The top layer may also be made of a transparent material.

In another example of the present disclosure, an exercise mat system comprises a base layer with a bottom surface, a top surface, a receiving surface, a receiving side, and at least one fastener, a top layer with a top surface, a bottom surface, and at least one fastener corresponding to the at least one fastener of the base layer, and an exercise mat insert. The receiving surface and receiving side of the base layer are configured to receive the exercise mat insert, and the at least one fastener of the base layer operatively connects with the corresponding at least one fastener of the top layer. In yet another example, the exercise mat insert is a cartridge including paint and at least one sheet of a painting surface. The top layer may be configured to roll away from the receiving surface of the base layer. The fasteners in the top layer and base layer may be magnets, and these magnets may even embedded within the top and base layers.

In another example of the present disclosure includes a base layer having a bottom surface, a top surface, and a fastening portion having at least one fastener, a top layer having a top surface with a first, second, third, and fourth edge, and a bottom surface, and a fastening mechanism connected to the top layer. The fastening mechanism of the top layer may be configured to operatively engage the fastening portion of the base layer. The fastening mechanism may extend along at least one of the first, second, third, or fourth edges of the top surface of the top layer. The fastening mechanism may include a channel with a sidewall, and this channel may be configured to receive the fastening portion of the base layer. In yet another example, the fastening portion of the base layer may include a magnet that operatively connects with either a metallic insert included in the fastening mechanism or another magnet within the fastening mechanism. The top layer may again be transparent, and, along with the base layer, it may be configured to receive an insert. The insert may include paint and at least one sheet of a painting surface. The paint may be thermochromic, and there may be multiple sheets of paper/canvas configured to be removed after each use.

In some embodiments or aspects, the present disclosure may be characterized by one or more of the following clauses:

Clause 1. An exercise mat comprising: a base layer, comprising a bottom surface, a top surface, and at least one fastener; and a top layer, comprising a bottom surface, a top surface, and at least one fastener wherein the at least one fastener operatively connects to the fastener of the base layer, wherein the top surface of the base layer and the bottom surface of the top layer are configured to be facing one another.

Clause 2. The exercise mat of clause 1, wherein the at least one fastener of the base layer and the at least one fastener of the top layers are magnets.

Clause 3. The exercise mat of clause 1 or 2, wherein the top layer is configured to roll away from the base layer.

Clause 4. The exercise mat of any of clauses 1-3, wherein the bottom surface of the top layer and the top surface of the bottom layer are configured to receive an insert between them.

Clause 5. The exercise mat of any of clauses 1-4, wherein the insert comprises a painting surface and paint.

Clause 6. The exercise mat of any of clauses 1-5, wherein the top layer is transparent.

Clause 7. An exercise mat system, comprising: a base layer, comprising a bottom surface, a top surface, a receiving surface, a receiving side, and at least one fastener; a top layer, comprising a top surface, a bottom surface, and at least one fastener corresponding to the at least one fastener of the base layer; and an exercise mat insert, wherein the receiving surface and receiving side of the base layer are configured to receive the exercise mat insert, wherein the at least one fastener of the base layer operatively connects with the corresponding at least one fastener of the top layer.

Clause 8. The exercise mat system of clause 7, wherein the exercise mat insert is a cartridge comprising paint and at least one sheet of a painting surface.

Clause 9. The exercise mat system of clause 7 or 8, wherein the top layer is configured to roll away from the receiving surface of the base layer.

Clause 10. The exercise mat system of any of clauses 7-9, wherein the at least one fastener of the base layer and the corresponding at least one fastener of the top layer are magnets.

Clause 11. The exercise mat system of any of clauses 7-10, wherein at least one magnet is embedded in the base layer and at least one magnet corresponding to the magnet embedded in the base layer is embedded in the top layer.

Clause 12. An exercise mat, comprising: a base layer, comprising a bottom surface, a top surface, and a fastening portion, wherein the fastening portion further comprises at least one fastener; a top layer, comprising a top surface having a first edge, a second edge, a third edge, and a fourth edge, and a bottom surface; and a fastening mechanism connected to the top layer, wherein the fastening mechanism is configured to operatively engage the fastening portion of the base layer.

Clause 13. The exercise mat of clause 12, wherein the fastening mechanism extends along at least one of the first edge, the second edge, the third edge, or the fourth edge.

Clause 14. The exercise mat of clause 12 or 13, wherein the fastening mechanism comprises a channel having a sidewall, wherein the channel is configured to receive the fastening portion of the base layer.

Clause 15. The exercise mat of any of clauses 12-14, wherein the fastening portion of the base layer comprises a magnet and the channel of the fastening mechanism further comprises a metallic insert to operatively connect the base layer and the top layer.

Clause 16. The exercise mat of any of clauses 12-15, wherein the channel of the fastening mechanism comprises at least one magnet to operatively connect with the magnet of the base layer.

Clause 17. The exercise mat of any of clauses 12-16, wherein the top layer is transparent.

Clause 18. The exercise mat of any of clauses 12-17, wherein the top layer and the base layer are configured to receive an insert therebetween.

Clause 19. The exercise mat of any of clauses 12-18, wherein the insert comprises paint and at least one sheet of a painting surface, wherein the paint is thermochromic.

Clause 20. The exercise mat of any of clauses 12-19, wherein the insert further comprises multiple sheets of painting surfaces configured to be removed from the insert after use.

These and other features and characteristics of the yoga mat, as well as the methods of operation and functions of the related elements of the yoga mat, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

BRIEF DESCRIPTION OF THE DRAWINGS

In FIGS. 1-6B, unless otherwise noted, same reference numbers are used to identify same components in various embodiments.

DESCRIPTION OF THE DISCLOSURE

Figure 1:
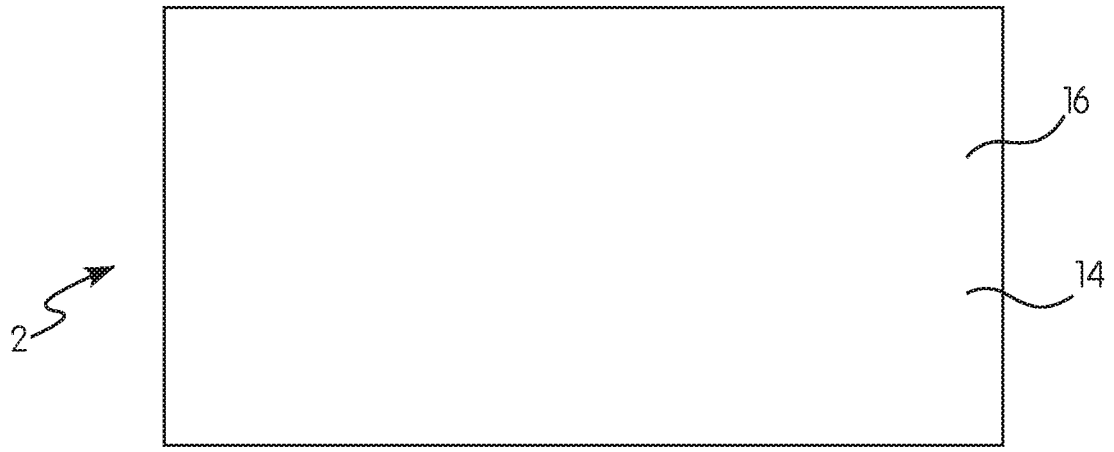
FIG. 1 is a top view of a yoga mat according to one example of the present disclosure.

For purposes of the description hereinafter, the terms "upper", "lower", "right", "left", "vertical", "horizontal", "top", "bottom", "lateral", "longitudinal", and derivatives thereof, shall relate to the invention as it is oriented in the figures. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

As used herein, the singular form of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

Referring to the drawings in which like reference numerals refer to like parts throughout the several views thereof, the present disclosure is generally directed to an exercise mat and, more particularly, to a yoga mat including a chamber for paint and a painting surface chamber. It is to be understood, however, that the features of the yoga mat can be applied and used with any type of exercise mat or similar mat on which practitioners apply pressure.

Figure 2A:
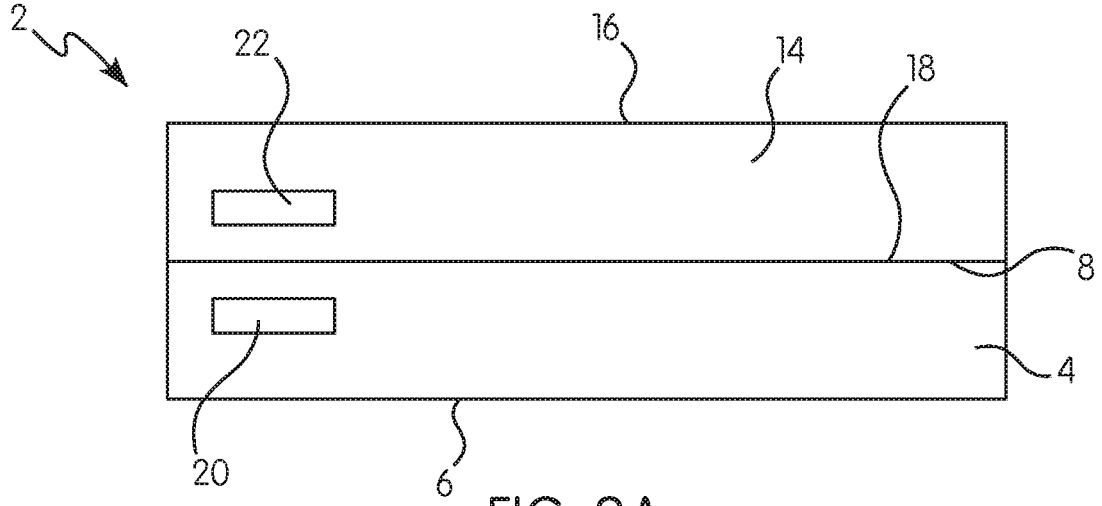
FIG. 2A is a side view of the yoga mat of FIG. 1.
Figure 2B:
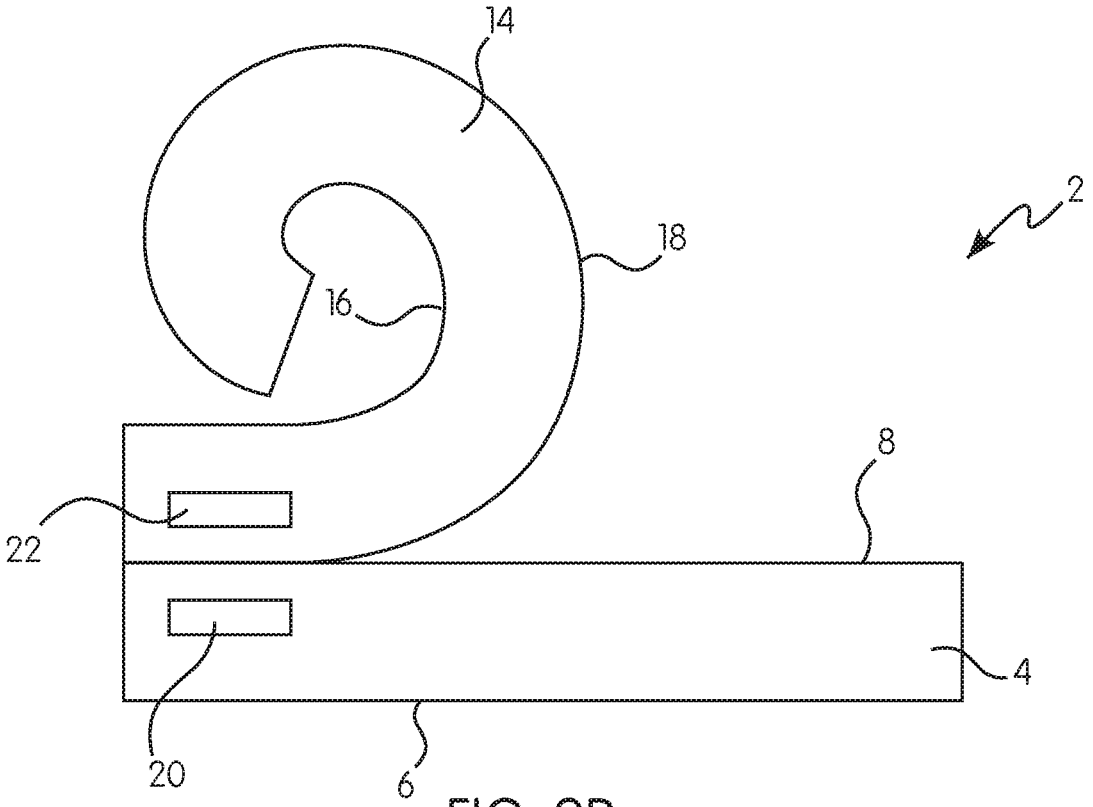
FIG. 2B is a side view of the yoga mat of FIG. 1.
Figure 2C:
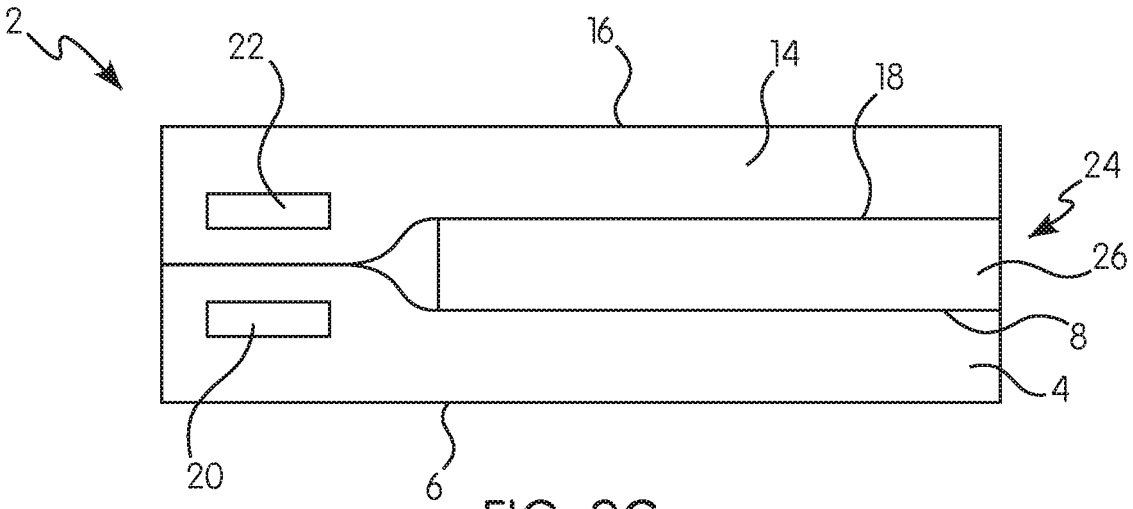
FIG. 2C is a side view of the yoga mat of FIG. 1 containing an insert.

With reference to FIGS. 1-2C, in some embodiments or aspects, an exercise mat may be in the form of a yoga mat 2. The yoga mat 2 includes a top surface 16 engaged by a practitioner when the yoga mat 2 is in use. A bottom surface 6 can be placed on the ground or floor outward and opposite the top surface 16 when yoga mat 2 is in use.

In one embodiment or aspect of the present disclosure, the yoga mat 2 includes a base layer 4 and a top layer 14. The base layer 4 includes the bottom surface 6 of the yoga mat 2 and a top surface 8. The top layer 14 includes the top surface 16 of the yoga mat 2 and a bottom surface 18. The base layer 4 may be made of a material to support the weight of a practitioner standing or resting on the yoga mat 2. This material may be foam, vinyl, silicone, or another material suitable for a practitioner's use. The top layer 14 may be a transparent plastic or rubber sheet that is placed over the base layer 4 so that the bottom surface 18 of the top layer 14 covers the top surface 8 of the base layer 4.

As shown in FIGS. 2A-2C, the base layer 4 and the top layer 14 may be connected to one another by magnets 20, 22 that establish a magnetic connection and serve to hold the base layer 4 and the top layer 14 together. The magnets 20, 22 may be attached to the base 4 and top 14 layers, or, as shown in FIGS. 2A-2C, the magnets 20, 22 may be embedded within the base 4 and top 14 layers. Both the base layer 4 and the top layer 14 may include a plurality of attached or embedded magnets 20, 22 to facilitate a proper connection between the base 4 and top 14 layers. It is contemplated that other connection arrangements between the base 4 and top 14 layers may be used. Other arrangements to connect the base 4 and top 14 layers may include adhesive, mechanical fasteners, stitching, staples, zippers, buttons, u-channels, tracking systems such as zip lock, or other similar connection methods.

As shown in FIG. 2B, a practitioner may use the magnets 20, 22 to connect the base 4 and top 14 layers together and roll, remove, or peel back a portion of the top layer 14 away from the base layer 4 to expose a portion of the top surface 8 of the base layer 4. By exposing a portion of the top surface 8 of the base layer 4, a practitioner may place an insert 24 on the top surface 8 of base layer 4.

Figure 3:
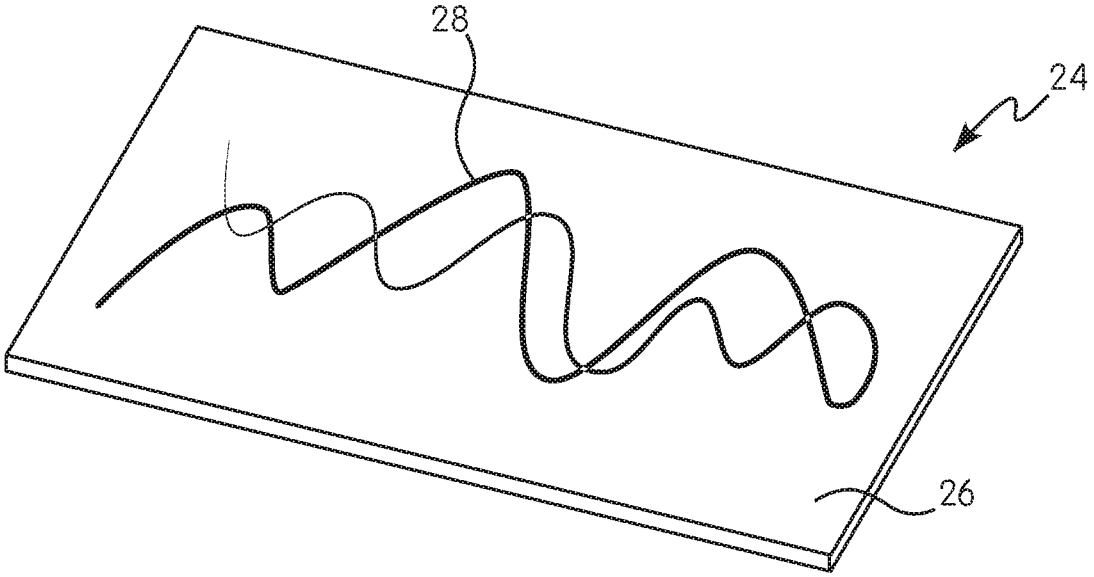
FIG. 3 is a perspective view of the insert of the present disclosure including a paint and painting surface arrangement.

With reference to FIG. 3, the insert 24 may be a painting surface 26 having paint 28 placed thereon. It is contemplated that other material suitable for creating artwork, such as canvas and paint, may be used. Paper or other fabrics may also be used with paint. The practitioner can apply paint 28 to the painting surface 26. The paint 28 can be applied in a variety of methods including dispensing the paint from paint tubes, paint cans, similar paint containers, paint brushes, paint cartridges, or similar paint application tools. It is also contemplated that the insert 24 be in the form of a cartridge where the cartridge contains both the paint 28 and the painting surface 26 to be used by the practitioner. In one embodiment, the cartridge may contain multiple layers or sheets of the painting surface 26, so after use, a practitioner may remove the cartridge, tear away the sheet or layer of the painting surface 26 containing the used paint 28, and then reinsert the cartridge for further use. In this embodiment, the paint 28 may be placed on each sheet of the painting surface 26 within the cartridge prior to using the first sheet of the painting surface 26 within the cartridge, or the paint may be dispensed from the cartridge onto the top sheet of the painting surface 26 prior to the reinsertion of the cartridge and the use of the top sheet of the painting surface 26. The cartridge may be made out of flexible material such as rubber or vinyl so that a practitioner may still properly practice on yoga mat 2 containing a cartridge insert 24. After placing the insert on the top surface 8 of the base layer 4, the top layer 14 is then replaced over top of the insert 24 and the base layer 4.

As shown in FIG. 2C, the bottom surface 18 of the top layer 14 lays over both the insert 24 and the base layer 4. This configuration permits the practitioner to use yoga mat 2 as they would normally. Since the top layer 14 is transparent, the practitioner can see the paint 28 through the top layer 14. As the practitioner moves between different poses on the yoga mat 2, the paint 28 is spread and applied to the painting surface 26 to create a painting for the practitioner. After the practitioner has completed the yoga routine, the top layer 14 is again rolled back from the base layer 4 and the painting is removed from the top surface 8 of the base layer 4. The practitioner can then insert new paint 28 and a painting surface 26 or an insert or cartridge 24 filled with paint 28 and the painting surface 26 to create a new painting the next time the yoga mat 2 is used.

Figure 4A:
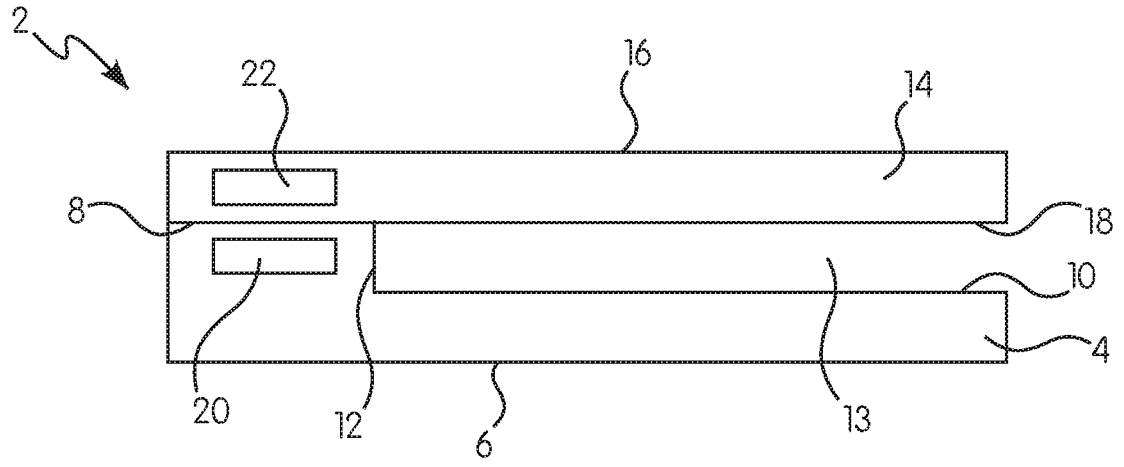
FIG. 4A is a side view of a yoga mat according to another example of the present disclosure.
Figure 4B:
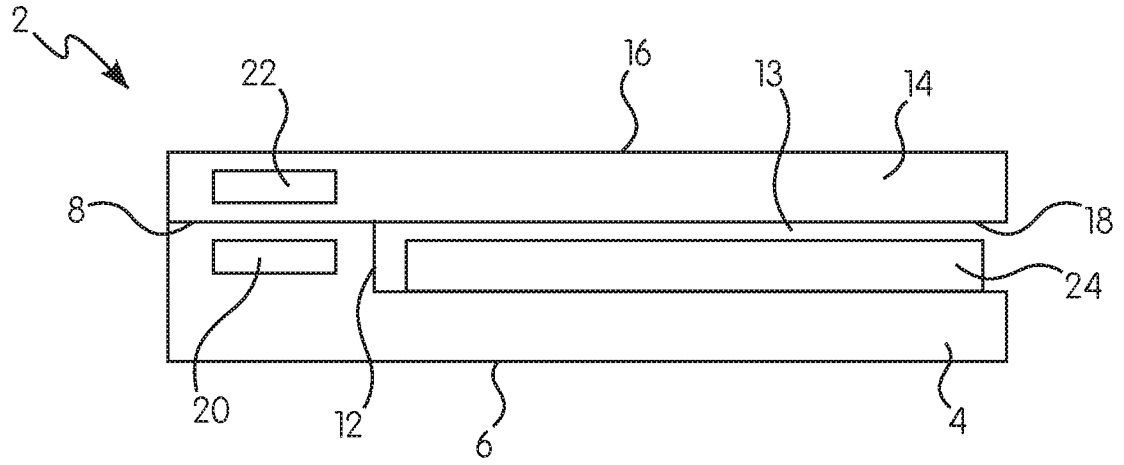
FIG. 4B is a side view of a yoga mat of FIG. 4A containing an insert

With reference now to FIGS. 4A and 4B, in another embodiment or aspect of the disclosure, the base layer 4 may define a recess 13 configured to receive the insert 24 within the yoga mat 2. The recess 13 is further defined by a receiving surface 10 and a receiving sidewall 12 on the base layer 4. A portion of the top layer 14 may be peeled or rolled away from the base layer 4 to expose the receiving surface 10 of the base layer 4. By exposing the receiving surface 10 of the base layer 4, a practitioner may place an insert 24 on the receiving surface 10. The practitioner may place the insert 24 up against the receiving sidewall 12 to properly place the insert 24 within the recess 13. By placing the insert 24 into the recess 13 of the base layer 4 and replacing the top layer 14 over top of the insert 24, recess 13, and base layer 4, the practitioner has the added benefit of having a relatively flat top surface 16 upon which to exercise and create a piece of art as described above.

Figure 5:
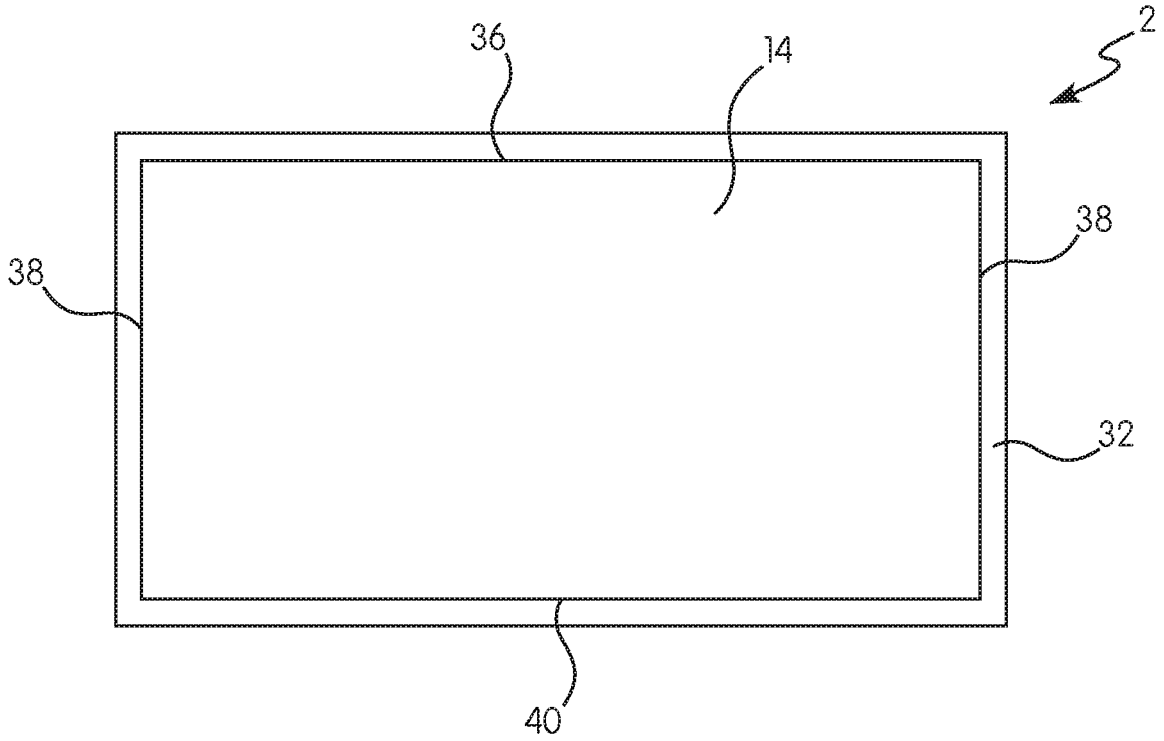
FIG. 5 is a top view of a yoga mat according to another example of the present disclosure.
Figure 6A:
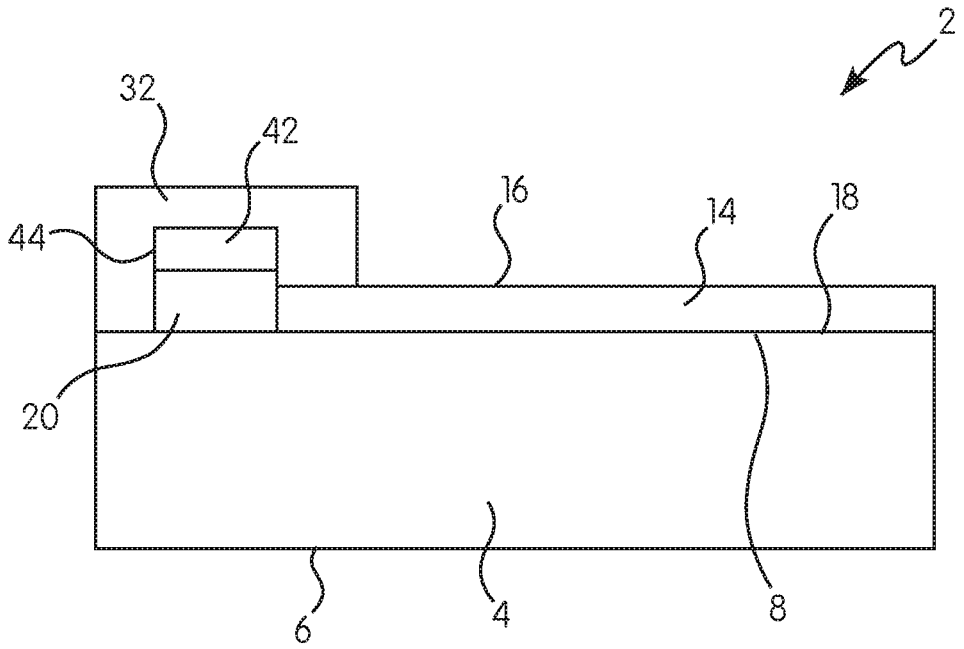
FIG. 6A is a side view of the yoga mat of FIG. 5.
Figure 6B:
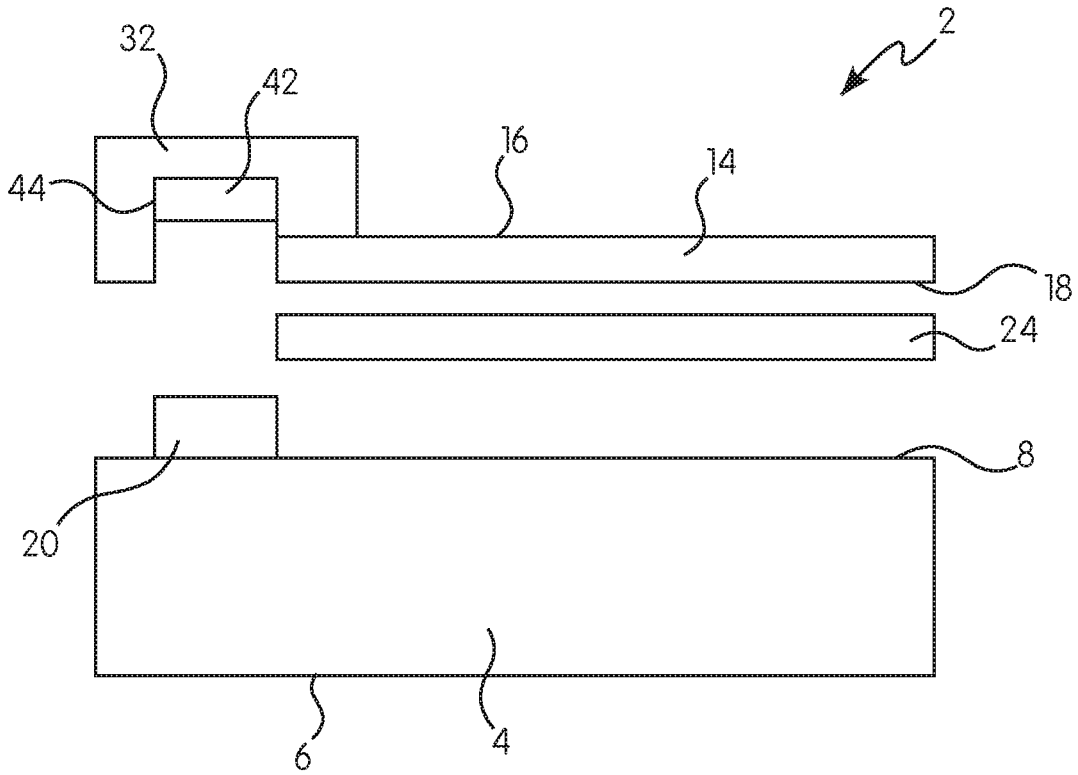
FIG. 6B is an exploded side view of the yoga mat of FIG. 5 including an insert.

With reference to FIGS. 5-6B, another example of the yoga mat according to the present disclosure is shown and described. The yoga mat 2 includes a fastening mechanism 32 to connect the base layer 4 to the top layer 14. The fastening mechanism 32, as shown in FIG. 5, may extend around the first, second, third, and fourth edge 34, 36, 38, 40 of the top layer 14. It is further contemplated that the fastening mechanism 36 may only extend along any one of the edges or any combination thereof.

As shown in FIGS. 6A and 6B, the fastening mechanism 32 may be a U-shaped channel further defined by a sidewall 44. The fastening mechanism may be made of rubber, foam, or another suitable material so that it is substantially flexible so as to be used in the present configuration described below. The fastening mechanism 36 may include a magnet 42 to facilitate a connection to the base layer 4. The magnet 42 included with the fastening mechanism 36 corresponds to a magnet 20 included with the base layer 4. The magnets 42, 20, as shown in FIGS. 6A and 6B, may be attached to the fastening mechanism 32 and the base layer 4, or, as shown in FIGS. 2A-2C, the magnets 42, 20 may be embedded in the fastening mechanism 32 and the base layer 4. Both the base layer 4 and the fastening mechanism 36 may include a plurality of magnets 42, 20 to facilitate a proper connection between the fastening mechanism 36 and the base layer 4. It is contemplated that, instead of a magnet, a metallic strip may be inserted into, embedded in, or attached to the fastening mechanism 36. A metallic strip would further facilitate a connection with magnet 20 to ensure the fastening mechanism is connected with base layer 4. It is to be understood that other connection arrangements may be used to connect the fastening mechanism 32 and base layer 4 including adhesive, mechanical fasteners, stitching, staples, zippers, buttons, locks and keys, u-channels, tracking systems such as zip lock, or other similar connection methods.

The top layer 14 is connect to the fastening mechanism, so that when the yoga mat 2 is in use, the bottom surface 18 of the top layer 14 is placed against the top surface 8 of the base layer 4. When the fastening mechanism 32 is connected to the base layer 4 the practitioner is able to roll, remove, or peel back a portion of the top layer 14 away from the base layer 4 to expose a portion of the top surface 8 of the base layer 4. By exposing a portion of the top surface 8 of the base layer 4, a practitioner may place the insert 24 including the painting surface 26 and paint 28 on the top surface 8 of base layer 4. The practitioner may then place the top layer 14 back over the insert 24 and base layer 4. If the fastening mechanism 32 extends along all four edges 34, 36, 38, 40 of the top layer 14, then one or more practitioners can pinch the fastening mechanism 32 at the location of the magnets in order to break the magnetic connection between the magnets 44, 20, remove the top layer 14 from the base layer 4, and place the insert 24 on the top surface 8 of the base layer 4. The practitioner(s) can then replace the fastening mechanism 32 and top layer 14 over the base layer 4 and use the yoga mat 2. Because the top layer 14 is transparent, the practitioner can see the paint 28 through the top layer 14. As the practitioner moves between different poses on the yoga mat 2, the paint 28 is spread across and further applied to the painting surface 26 to create a painting for the practitioner. After the practitioner has completed the yoga routine, the fastening mechanism 32 and the top layer 14 are removed from the base layer 4 or the top layer 14 is peeled or rolled off of the base layer 4 and the painting is removed from the base layer 4. The process can be repeated as many times as the practitioner likes, and because different combinations of exercises or movements on the yoga mat 2 result in the paint 28 being spread across the painting surface 26 in different manners, different combinations of exercises create different paintings.

While several examples of an exercise or yoga mat were shown in the accompanying figures and described in detail hereinabove, other examples will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. An exercise mat, comprising:

a base layer, comprising a bottom surface, a top surface, and at least one fastener; and a top layer, comprising a bottom surface, a top surface, and at least one fastener wherein the at least one fastener operatively connects to the fastener of the base layer, wherein the top surface of the base layer and the bottom surface of the top layer are configured to be facing one another, wherein the exercise mat further comprises an insert, the insert comprises paper and paint, and wherein the bottom surface of the top layer and the top surface of the base layer are configured to receive the insert between them.

2. The exercise mat of claim 1, wherein the at least one fastener of the base layer and the at least one fastener of the top layer are magnets.

3. The exercise mat of claim 1, wherein the top layer is configured to roll away from the base layer.

4. The exercise mat of claim 1, wherein the top layer is transparent.

5. An exercise mat system, comprising:

a base layer, comprising a bottom surface, a top surface, a receiving surface, a receiving side, and at least one fastener;

a top layer, comprising a top surface, a bottom surface, and at least one fastener corresponding to the at least one fastener of the base layer; and an exercise mat insert, wherein the receiving surface and receiving side of the base layer are configured to receive the exercise mat insert, wherein the at least one fastener of the base layer operatively connects with the corresponding at least one fastener of the top layer, and wherein the exercise mat insert is a cartridge comprising paint and at least one sheet of paper.

6. The exercise mat system of claim 5, wherein the at least one fastener of the base layer and the corresponding at least one fastener of the top layer are magnets.

7. The exercise mat system of claim 6, wherein at least one magnet is embedded in the base layer and at least one magnet corresponding to the magnet embedded in the base layer is embedded in the top layer.

8. An exercise mat, comprising:

a base layer, comprising a bottom surface, a top surface, and a fastening portion, wherein the fastening portion further comprises at least one fastener;

a top layer, comprising a top surface having a first edge, a second edge, a third edge, and a fourth edge, and a bottom surface; and a fastening mechanism connected to the top layer, wherein the fastening mechanism is configured to operatively engage the fastening portion of the base layer, wherein the exercise mat further comprises an insert, the insert comprises paint and at least one sheet of paper, wherein the paint is thermochromic, and wherein the top layer and the base layer are configured to receive the insert therebetween.

9. The exercise mat of claim 8, wherein the fastening mechanism extends along at least one of the first edge, the second edge, the third edge, or the fourth edge.

10. The exercise mat of claim 9, wherein the fastening mechanism comprises a channel having a sidewall, wherein the channel is configured to receive the fastening portion of the base layer.

11. The exercise mat of claim 10, wherein the fastening portion of the base layer comprises a magnet and the channel of the fastening mechanism further comprises a metallic insert to operatively connect the base layer and the top layer.

12. The exercise mat of claim 10, wherein the channel of the fastening mechanism comprises at least one magnet to operatively connect with the magnet of the base layer.

13. The exercise mat of claim 12, wherein the top layer is transparent.

14. The exercise mat of claim 8, wherein the insert further comprises multiple sheets of paper configured to be removed from the insert after use.

15. The exercise mat system of claim 5, wherein the top layer is configured to roll away from the receiving surface of the base layer.

* * * * *